US009504907B2

(12) United States Patent
Carter

(10) Patent No.: US 9,504,907 B2
(45) Date of Patent: Nov. 29, 2016

(54) SIMULATED SHOOTING SYSTEM AND METHOD

(71) Applicant: George Carter, Dallas, TX (US)

(72) Inventor: George Carter, Dallas, TX (US)

( * ) Notice: Subject to any disclaimer, the term of this patent is extended or adjusted under 35 U.S.C. 154(b) by 0 days.

(21) Appl. No.: 14/498,112

(22) Filed: Sep. 26, 2014

(65) Prior Publication Data

US 2015/0018057 A1 Jan. 15, 2015

Related U.S. Application Data

(63) Continuation-in-part of application No. 14/168,951, filed on Jan. 30, 2014, now Pat. No. 8,888,491, which is a continuation-in-part of application No. 13/611,214, filed on Sep. 12, 2012, now Pat. No. 8,678,824, which is a continuation-in-part of application No. 12/608,820, filed on Oct. 29, 2009, now Pat. No. 8,459,997.

(60) Provisional application No. 61/156,154, filed on Feb. 27, 2009.

(51) Int. Cl.

| | |
|---|---|
| ***F41A 33/00*** | (2006.01) |
| ***A63F 9/02*** | (2006.01) |
| ***F41G 3/26*** | (2006.01) |

(52) U.S. Cl.

CPC ..... *A63F 9/0291* (2013.01); *F41A 33/00* (2013.01); *F41G 3/26* (2013.01)

(58) Field of Classification Search

CPC ..... F41A 33/00; F41A 33/02; F41A 33/04; F41A 33/06; F41G 3/26; F41G 3/2655; A63F 9/0291

USPC ..... 434/11–26

See application file for complete search history.

(56) References Cited

U.S. PATENT DOCUMENTS

| | | | | |
|---|---|---|---|---|
| 5,215,462 | A | 6/1993 | Lewis et al. | |
| 6,813,593 | B1 | 11/2004 | Berger | |
| 6,899,539 | B1 | 5/2005 | Stallman et al. | |
| 7,329,127 | B2 | 2/2008 | Kendir et al. | |
| 8,246,467 | B2 | 8/2012 | Huang et al. | |
| 2005/0181745 | A1* | 8/2005 | Wood et al. | 455/90.3 |
| 2007/0190494 | A1* | 8/2007 | Rosenberg | 434/11 |
| 2007/0243504 | A1* | 10/2007 | Bjorkman et al. | 434/22 |
| 2015/0057057 | A1* | 2/2015 | Fischer | F41G 3/2655 463/7 |

* cited by examiner

*Primary Examiner* — Timothy A Musselman
(74) *Attorney, Agent, or Firm* — Michael Diaz

(57) ABSTRACT

A shooting simulation system. The system includes a plurality of communication devices with each communication device associated with a separate player. In addition, each mobile phone includes an A-GPS device for determining a location indicia of the communication device and a mechanism for communicating the location indicia to a network. A game server communicates with the network for relaying the location indicia of each communication device to all of the communication devices. Each communication device includes a mechanism for determining a directional orientation of the communication device when aimed and a processor for determining if a simulated targeting of another player is a hit or miss based on the location indicia of a shooting communication device, the location indicia of a communication device of a targeted player, and the directional orientation of the shooting communication device.

30 Claims, 7 Drawing Sheets

SIMULATED SHOOTING SYSTEM AND METHOD

RELATED APPLICATIONS

This application is a continuation-in-part application of co-pending U.S. patent application Ser. No. 14/168,951 entitled "An Optical Recognition System and Method For Simulated Shooting" filed on Jan. 30, 2014 under the name of George Carter which is a continuation-in-part application of U.S. Pat. No. 8,678,824 entitled "Shooting Simulation System and Method Using an Optical Recognition System" filed on Sep. 12, 2012 under the name of George Carter which is a continuation-in-part application of U.S. Pat. No. 8,459,997 entitled "Shooting Simulation System and Method" filed on Oct. 29, 2009 under the name of George Carter which claims the benefit of U.S. Provisional Patent Application Ser. No. 61/156,154 filed Feb. 27, 2009 by George Carter, all of which is hereby incorporated by reference.

BACKGROUND OF THE INVENTION

Field of the Invention

This invention relates to simulation systems and methods. Specifically, and not by way of limitation, the present invention relates to a shooting simulation system and method.

Description of the Related Art

There are numerous laser tag games utilizing Infrared (IR) emitters and sensors for playing various forms of tag. However, these laser tag games require the use of relatively expensive IR emitters and sensors. It would be advantageous to have a system and method utilizing ordinary mobile phones for playing various forms of tag. It is an object of the present invention to provide such a system and method.

SUMMARY OF THE INVENTION

In one aspect, the present invention is directed to a shooting simulation system. The system includes a plurality of communication devices with each communication device associated with a separate player. In addition, each mobile phone includes an Assisted Global Positioning System (A-GPS) device for determining a location indicia of the communication device and a mechanism for communicating the location indicia to a network. A game server communicates with the network for relaying the location indicia of each communication device to all of the communication devices. Each communication device includes a mechanism for determining a directional orientation of the communication device when aimed and a processor for determining if a simulated targeting of another player is a hit or miss based on the location indicia of a shooting communication device, the location indicia of a communication device of a targeted player, and the directional orientation of the shooting communication device.

In another aspect, the present invention is directed to a method of simulating targeting a target. The method begins by carrying a shooting communication device by a first player and a targeted communication device being carried by a targeted second player. A geographic location of the shooting communication device and the targeted communication device are then determined. Next, the geographic location of the targeted communication device to the shooting communication device through a network is determined. The shooting communication device aims and targets the second player. An orientation of the aimed shooting communication device is determined and, from this orientation and the location of the targeted communication device, a hit is determined.

DESCRIPTION OF THE INVENTION

Figure 1:
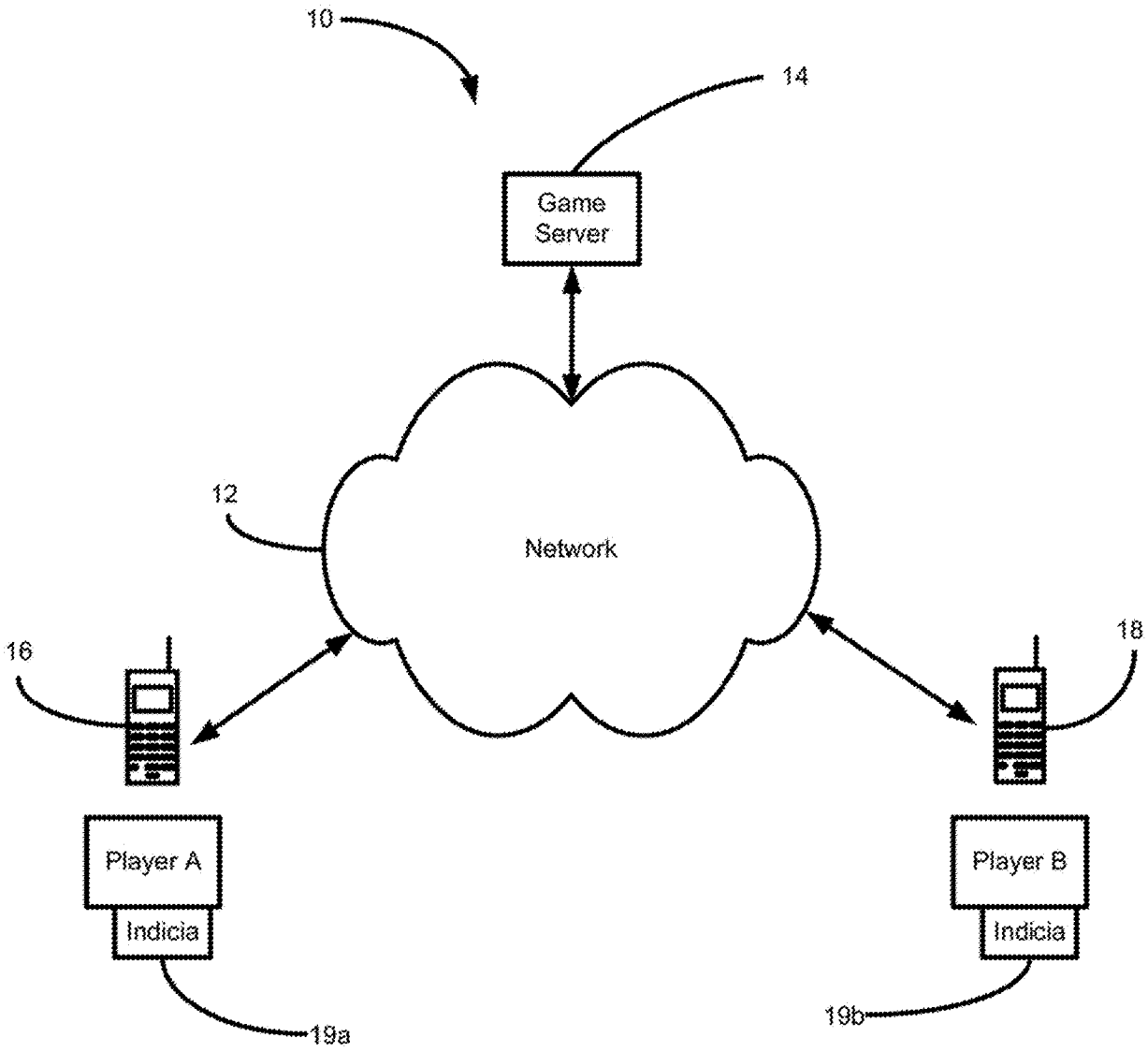
FIG. 1 is a simplified block diagram of a shooting simulation system.

The present invention is a shooting simulation system and method. FIG. 1 is a simplified block diagram of a shooting simulation system 10 in one embodiment of the present invention. The system 10 includes a wireless network 12, game server 14, and a plurality of mobile phones 16 and 18. The wireless network 12 may be any wireless communications network, such as a cellular network, any type of telecommunications network, Wi-Fi, etc. The game server 14 is a computing device communicating with the plurality of mobile phones 16 and 18 via the network 12. The mobile phones 16 and 18 may be any communication device capable of communicating via the wireless network, such as a tablet, phablet, portable computer, etc. It should be understood that the term "mobile phone" shall encompass any of these communication devices. Furthermore, two mobile phones are depicted, however any number of mobile phones may be utilized in the present invention. In addition, each mobile phone may function as a simulated firearm or aiming/targeting device for a simulated airborne weapon system, such as a notional airborne drone. Additionally, each mobile phone is carried by a player. As shown in FIG. 1, the mobile phone 16 is associated with a player A and mobile phone 18 is associated with a player B.

In one embodiment, each player A and B includes a specific indicia 19 (19*a* is associated with player A and indicia 19*b* is associated with player B) associated with the player. The indicia 19 may be any type of indicia to include color codes, bar codes, the shape of a helmet, shape of a typical person's face, infrared signatures, modulating retroreflectors (MRRs), and other spectral images. Additionally, indicia may include the identification of a target silhouette. However, in the preferred embodiment of the present invention, the indicia provide a geographical position and optionally an identification of the mobile phone and its associated player.

Figure 2:
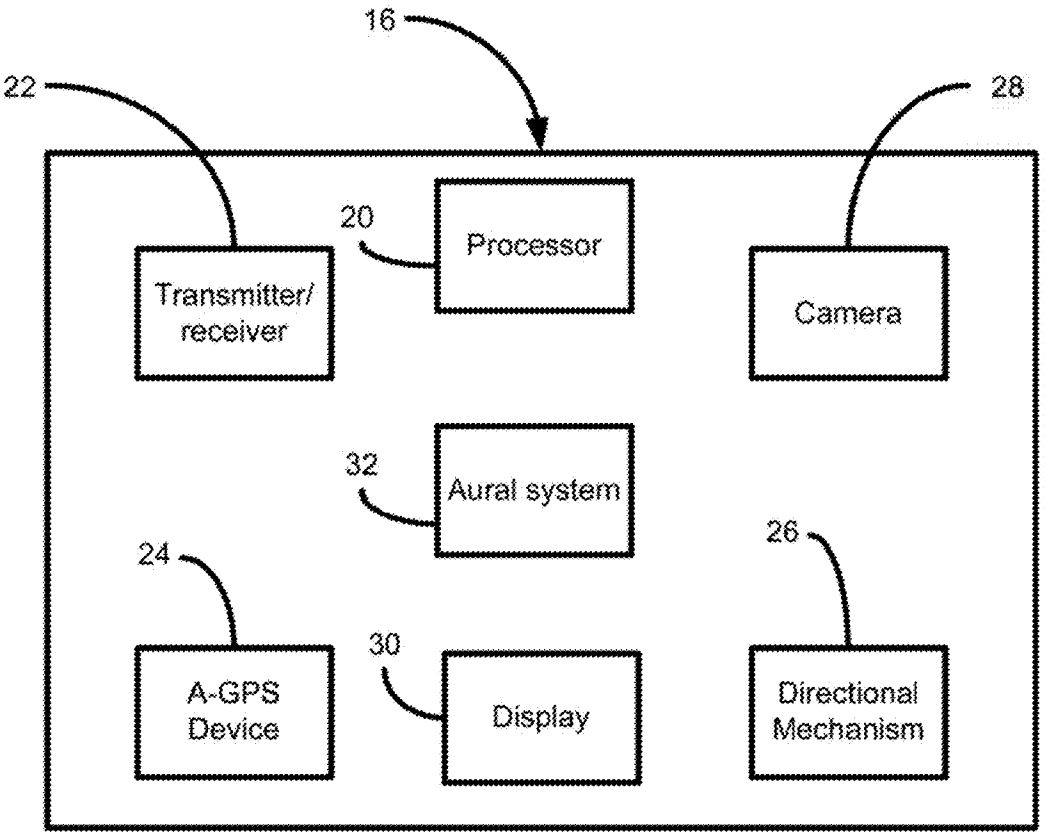
FIG. 2 is a simplified block diagram of the components of a mobile phone in one embodiment of the present invention.

FIG. 2 is a simplified block diagram of the components of a mobile phone in one embodiment of the present invention. The mobile phone 16 includes a processor 20, a transmitter/receiver 22, an Assisted Global Positioning System (A-GPS) device 24, a directional mechanism 26 for determining a directional orientation of an aimed mobile phone, and an optional camera 28. The directional mechanism may be incorporated into the A-GPS device or be a separate component utilizing one or more accelerometers or a magnetometer to ascertain a direction of the aimed mobile phone. The processor 20 may be any computing device and incorporate the use of a software application, mobile application (e.g., "app") to accomplish the functions of the present invention.

Figure 3:
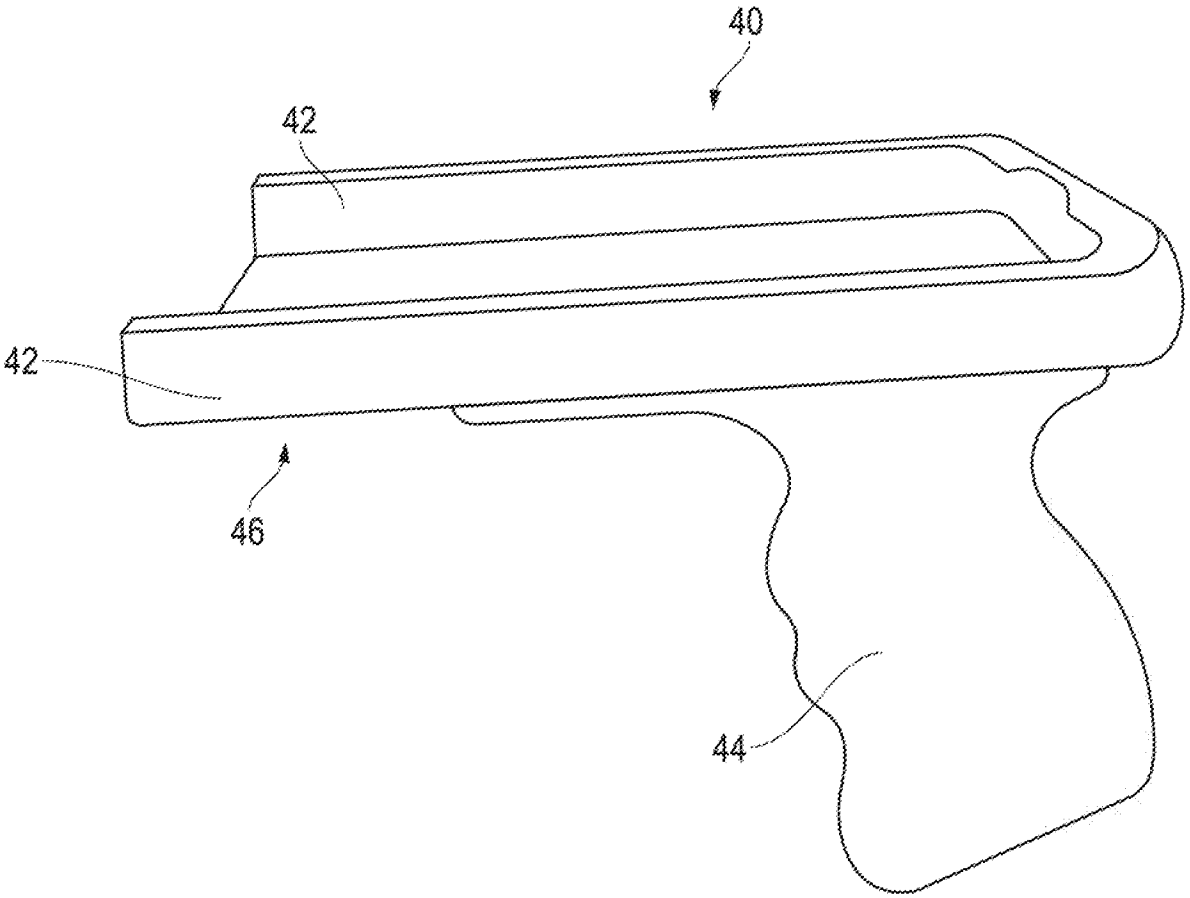
FIG. 3 is a front perspective view of a mobile phone case for use with the mobile phone.
Figure 4:
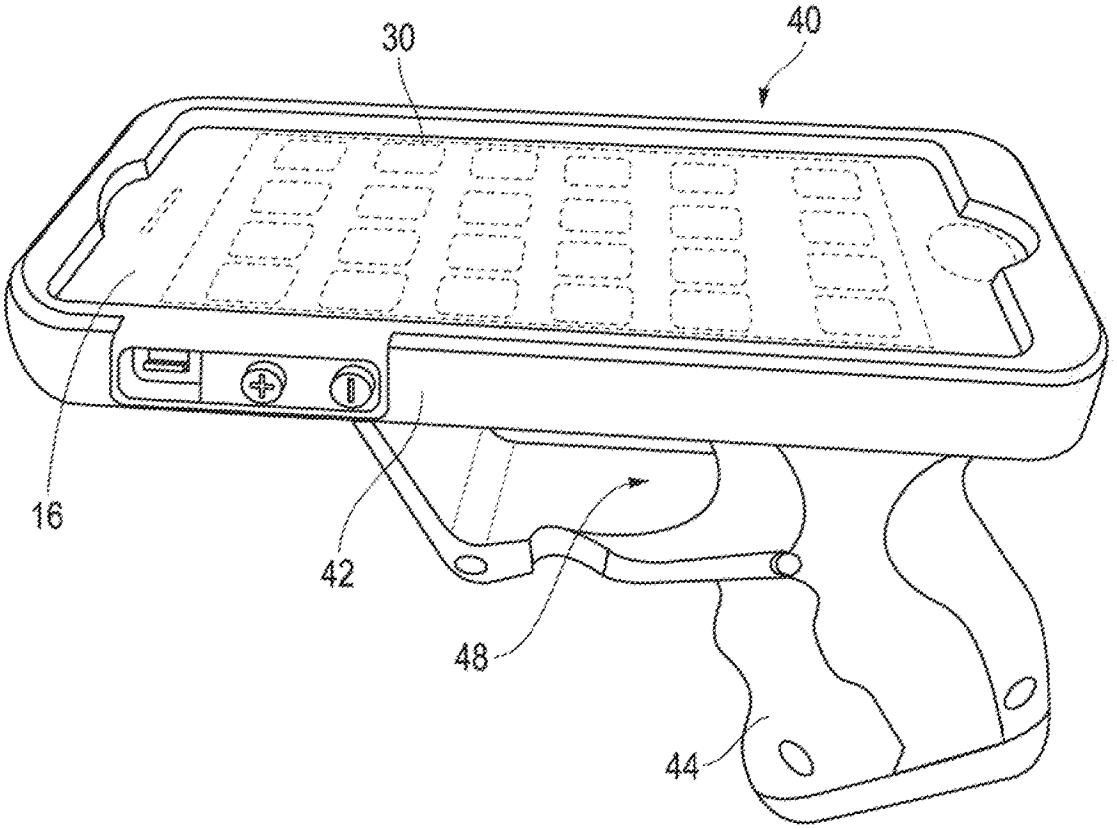
FIG. 4 is a front perspective view of the mobile phone inserted within the case of FIG. 3.

The mobile phone may be a firearm facsimile or affixed to a device to simulate a firearm. In another embodiment, the mobile phone is a targeting device for targeting a target for a strike by a notional airborne drone. FIG. 3 is a front perspective view of a mobile phone case 40 for use with the mobile phone 16. The case 40 includes a mobile phone case sized and shaped to accommodate a mobile phone. The case is similar to many cases currently on the market in that the case includes a border 42 surrounding a mobile phone. The case 40 also includes a grip 44 affixed to a bottom surface 46 of the case, which is shaped to simulate a gun grip and optionally a trigger. FIG. 4 is a front perspective view of the mobile phone 16 inserted within the case 40 of FIG. 3. The mobile phone may then be held by the grip 44. The grip may also include a trigger 48. In an active embodiment, the trigger 48 is coupled electronically, either wirelessly (e.g., Bluetooth) or via a cable or wire to the mobile phone. In this active embodiment, each trigger pull sends an electronic signal to the processor 20 of the mobile phone. In another passive embodiment, the trigger is not coupled electronically to the mobile phone. Actuation of the trigger may be detected by a clicking sound detected by a receiver of the mobile phone. In another embodiment, the mobile phone may not have any grip or trigger and the actuation of the simulated trigger may be by shaking the mobile phone, the player emitting a verbal command, or the player touching a touch screen icon or button. In addition, the case may include a lanyard for ease in carriage of the case and attached mobile phone.

In addition, the mobile phone may include an optional display 30 (see FIG. 2) for displaying information to the player, such as hit or miss cues and location of a friendly or opposing player and final game results. Furthermore, the mobile phone may also include an aural system 32 having a microphone and a speaker. The aural system may provide an indication of when a hit has been scored against the player, near miss cues (e.g., right/left verbal warnings or displays on a screen associated with the firearm), a realistic noise simulating the firing of a gun, or bullets approaching. The aural system may also provide a verbal call of the accuracy of the shot, such as "miss", "hit", or "miss right/left".

In one embodiment, the camera 28 may be utilized as an optical system which may include an image recording device and an optical image capturing device which captures an image when the trigger or simulated trigger is actuated. In this embodiment, the optical system is aligned relative to a known orientation or sight of the firearm and captures an image when the trigger 46 is actuated. The image is then captured and recorded by the optical system in the image recording device. The optical system may also include an image recognition program or system. The optional image recognition program may be utilized to identify an indicia of another player for identification of the target. In addition, the image recognition program may utilize silhouette extraction techniques of targets to determine and recognize a target. For instance, silhouette extraction of targets may be obtained by utilizing computer vision techniques as well as ancillary identifiers, such as color of uniform, helmets, gun shape, vehicle features, etc.

The optical system may determine, through its image recognition program or system, if the image is a recognizable target (e.g., a human form). The optical system may utilize several sources of information to verify the validity of the target. The presence of the indicia 19 or a detected infrared emission (e.g., heat) of the opposing player also may be used to identify a target. Furthermore, the optical system may utilize other mechanisms for detecting other types of spectral images.

The present invention may be utilized in a game or simulated combat scenario where players A and B are aligned on opposite sides. The present invention may utilize more than two players and include more than two teams. The players utilized their mobile phones 16 and 18 by aiming the mobile phones at an opposing player and actuating a trigger for simulating shooting at or targeting the opposing player. In one embodiment, the player is simulating direct fire, such as shooting a simulated line-of-sight weapon at the opposing player. In another embodiment, the player is aiming and simulating employing indirect fire, such as designating a target for a strike by a notional airborne drone, utilizing mortars, artillery, helicopters, etc. The mobile phone, through the processor, A-GPS device and communication with the game server, knows the location of the opposing player. The mobile phone is "aimed" at the opposing player, specifically the mobile phone is longitudinally aligned (directional or azimuth) with the desired target. Upon actuation of the trigger or simulated trigger, the processor may determine the direction of the mobile phone. It may be determined (adjudicated) by the processor of the shooting mobile phone or by the game server having a processor if there would be a hit or miss.

The game server 14 receives location data (e.g., A-GPS data from each mobile phone) and may independently determine/verify a hit or miss of the target. Since the game server may know the position of each player and the information on the triggered firearm (i.e., the orientation of the mobile phone), the game server may determine/verify a hit or miss. Alternatively, the game server may relay location data of the opposing player's mobile phone to the firing player's mobile phone and enable the processor 20 to determine if the fired shot would have been a hit or miss. Additionally, the game server 14 may manage the location of all the players as well as compiling all the hits and misses of each player at a specific location and time during the simulation. This compilation may be used for debrief of the players and determination of the success of each player and each team. The game server may compile a wide variety of data, such as time of firing, accuracy, number of bullets fired, times the player is targeted, etc. In one embodiment, the game server may provide a playback of each encounter providing a graphical representation of each player, trajectory of the simulated bullets, or targeting of the drone. Furthermore, the game server may send back information on a hit or miss to the intended target. For example, the target and its associated mobile phone may be informed that he is killed by receiving an aural warning. In addition, the game server may determine a size or pattern of what is defined as a "hit" or "miss". For example, a confirmed "hit" may be reduced to a smaller pattern (e.g., a smaller concentric circle or circles for which a hit is scored). Additionally, the game server may provide a handicap based on previous performance of the player for the determination of a hit.

Figure 5:
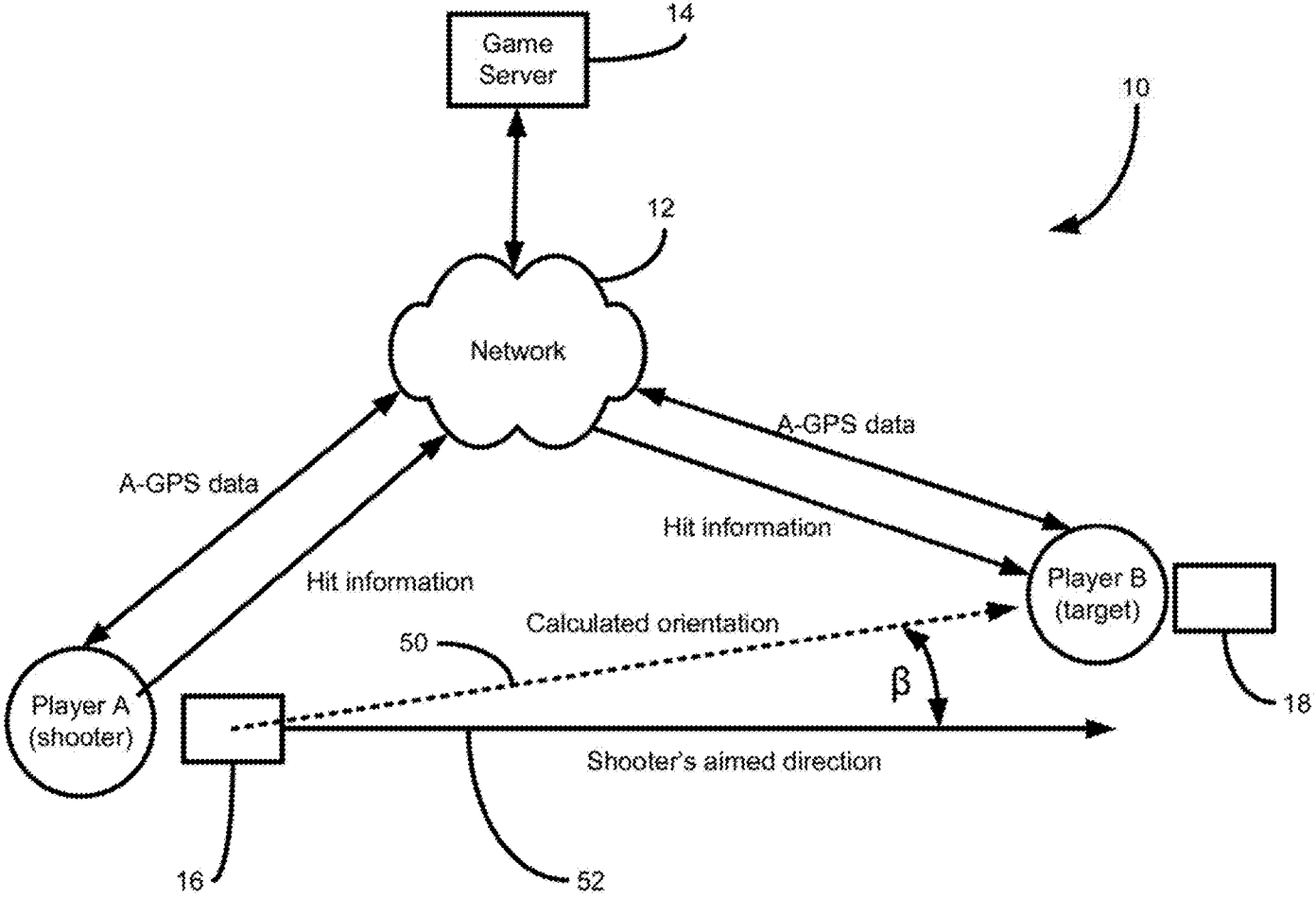
FIG. 5 is a simplified block diagram illustrating the interaction of the components for use in the present invention.

FIG. 5 is a simplified block diagram illustrating the interaction of the components for use in the present invention. With reference to FIGS. 1-5, the operation of the system 10 will now be explained. Each player carries a mobile phone 16 or 18. The mobile phone includes an A-GPS device 24 to determine the geographical location of the mobile phone. In one embodiment, the geographical information or A-GPS data is the indicia of the mobile phone and its associated player, which identifies the player. In one embodiment, each player's mobile phone receives the A-GPS data of the opposing player or players' mobile phones. A player, for example player A as shown in FIG. 5, aims the mobile phone 16 at a target, in this example, player B. The directional mechanism 26, which may be incorporated into the A-GPS device, ascertains an aimed direction or azimuth 52 for which the mobile phone is aimed. The processor 20, by knowing the location of mobile phone 16 (player A) and mobile phone 18 (player B), can determine a calculated orientation 50 between the two mobile phones. The game server 14 or the shooting mobile phone (e.g., mobile phone 16) may provide a hit criteria, such as a maximum β angular error for which a shot would be scored as a hit. The hit criteria may be set in various ways. In one embodiment, the radius of the "kill zone" may be increased or decreased as desired. Alternatively, the simulated bullet may be increased or decreased in size. Also, in one embodiment, rather than simulating a shooting firearm, the present invention may simulate targeting a player with a simulated airborne drone. In either case, a hit is determined by the directional accuracy. In another embodiment, the location of both mobile phones at the time of trigger actuation is sent to the game server which adjudicates whether the shot fired or targeting is a hit or miss. The information of a hit (and optionally a miss) may be relayed to either the shooting player or both the shooting and targeted players' mobile phones. It should be understood that trigger actuation refers to any shooting or targeting of an opposing player. Trigger actuation may be accomplished in a wide variety of ways. For example, the player may shake the mobile phone, touch a touch screen icon, emit a yell or other sound, etc. In addition, the mobile phone may be inserted into the mobile phone case which includes a grip 44. This case may be used to allow ease in carriage of the mobile phone as well as provide ease in aiming the mobile phone at a target. The grip may also include a trigger which may be either passively or actively connected to the mobile phone. For an active connection, the trigger 48 may be electronically coupled to the mobile phone (e.g., Bluetooth), which would register as a trigger pull. In the passive connection, there is no electronic connection between the trigger and the mobile phone. In one embodiment, the mobile phone may register a trigger actuation upon hearing a distinctive click from the trigger when pulled. In any case, trigger actuation is used to simulate either shooting the simulated firearm or targeting a player for attack by a notional airborne drone. The hits and/or misses may be relayed to the game server for a total tally by the game server. The communication between the mobile phones and the game server may utilize any wireless network, such as a telecommunications network.

Figure 6A:
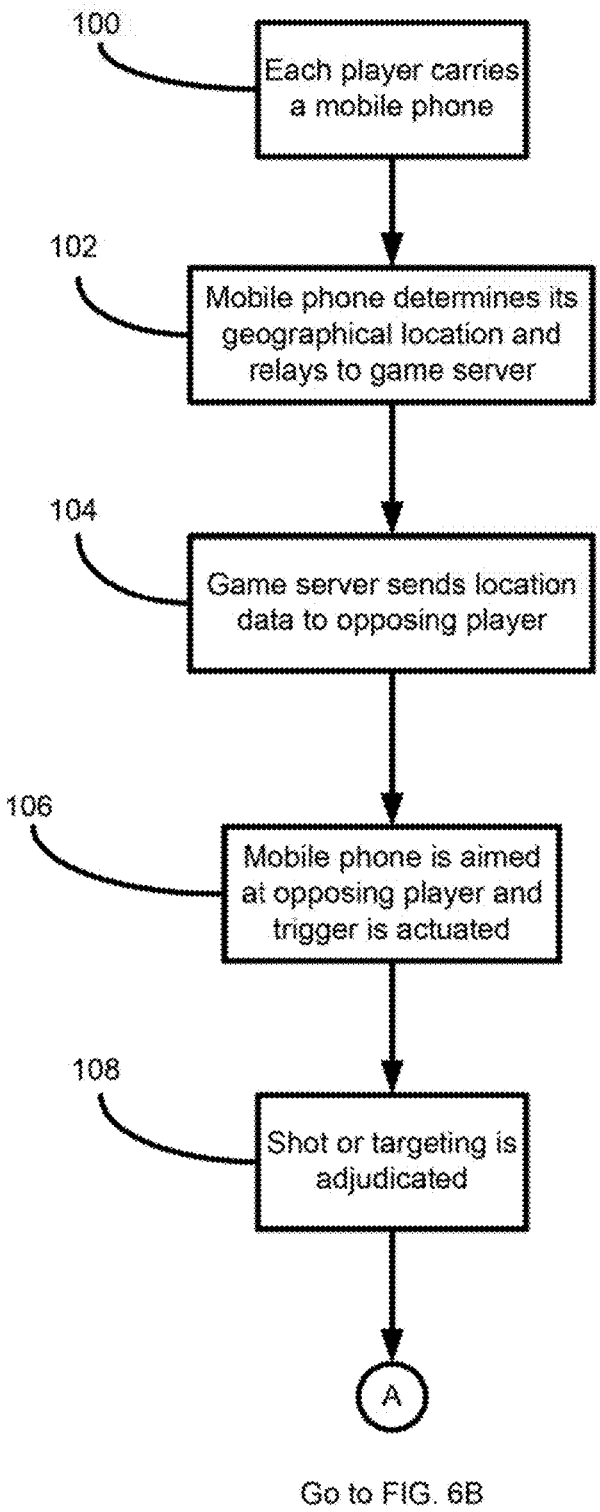
FIGS. 6A and 6B are flowcharts illustrating the steps of utilizing the system according to the teachings of the present invention.
Figure 6B:
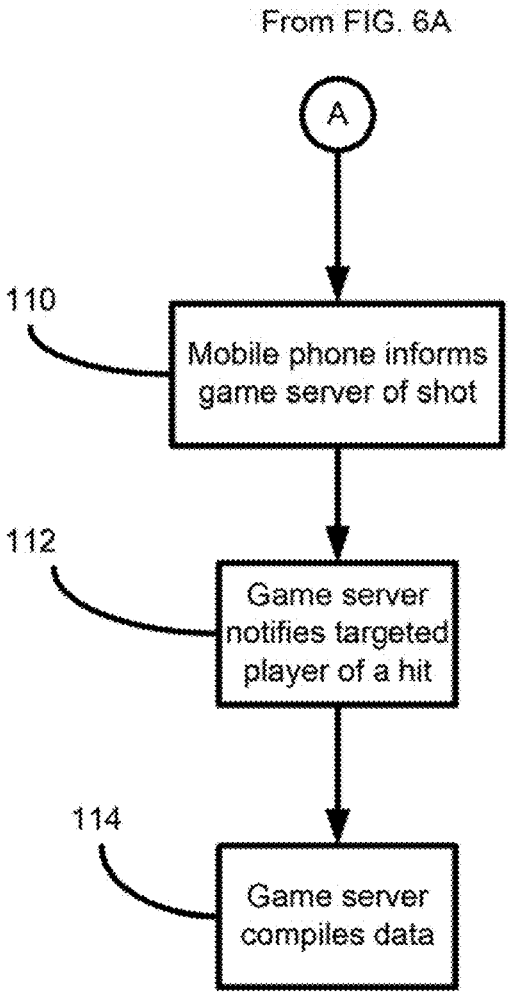

FIGS. 6A and 6B are flowcharts illustrating the steps of utilizing the system 10 according to the teachings of the present invention. With reference to FIGS. 1-6, the method will now be explained. In step 100, each player carries a mobile phone 16 or 18. In step 102, each mobile phone continually determines its geographical location or indicia and relays this information to the game server. In step 104, the game server 14 sends the opposing player's location information (indicia) to the other player (e.g., player B's geographical location is sent to player A's mobile phone). The opposing player's geographical information may optionally be displayed to the player for providing situational awareness of a general directional orientation of the player. In step 106, player A aims the mobile phone 16 at player B and actuates the trigger. The trigger may be a trigger 48 or actuated in a wide variety of ways, such as shaking the mobile phone or touching an icon on the mobile phone display. Next, in step 108, the shot or targeting is adjudicated. In one embodiment, the processor in the shooting player's mobile phone 16 adjudicates if the shot or targeting was a hit or miss. In another embodiment, the game server receives the aimed direction 50 and true orientation 52 and determines if the shot or targeting was a hit or miss. In step 110, the mobile phone 16 may inform the game server of the shot or targeting and optionally the results (i.e., hit or miss) for tally by the game server. The hit or miss information may then be relayed to the targeted player's mobile phone 18. Next, in step 112, the game server 14 may inform the targeted player B's mobile phone 18 of a hit. The mobile phone may be informed by either aural feedback (e.g., sound indicated that player B has been hit) or visual feedback (e.g., visual signal on display 30). In step 114, the game server 14 may then manage the location of all the players as well as compiling all the hits and misses of each player at a specific location and time during the simulation. This compilation may be used for debrief of the players and determination of the success of each player and each team. The game server may compile such data as time of firing, accuracy, number of bullets fired, times the player is targeted, etc.

The present invention provides many advantages over existing shooting simulation systems. The present invention does not require the wearing of sensors by players to detect a hit by a IR emitter or other device. Furthermore, the targeted player does not need to emit an active electronic emission and may be a passive target. Additionally, the shooting simulated firearm does not need to emit any spectral emissions to determine if the image is a legitimate target. Thus, the cost of equipment is drastically reduced. The present invention may be incorporated in existing mobile phones.

The present invention may be utilized between two players or multiple players on two or more teams. The present invention may be used as a shooting simulation system and method by a simulated shooting firearm or by a device for targeting a player with a notional airborne drone.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A shooting simulation system, the system comprising:

a plurality of communication devices, each communication device associated with a separate player, wherein each communication device includes an Assisted Global Positioning System (A-GPS) device for determining a location indicia of the communication device and a mechanism for communicating the location indicia to a network, the location indicia providing a location of the communication device;

a game server communicating with the network for relaying the location indicia of each communication device to the plurality of communication devices;

wherein each communication device includes a mechanism for determining a directional orientation of the communication device when aimed;

wherein a shooting communication device targeting a targeted player having a targeted communication device receives location indicia of the targeted communication device; and a shooting processor within the communications device for determining if a simulated targeting of another player is a hit or miss based on the location indicia of a shooting communication device, the location indicia of the targeted communication device of the targeted player received from the game server, and the directional orientation of the shooting communication device;

the shooting processor within the shooting communication device determining a hit or miss of the targeting of another player and providing immediate feedback of a hit or miss to a shooting of the shooting communication device.

2. The shooting simulation system according to claim 1 wherein the communication device is a mobile phone.

3. The shooting simulation system according to claim 2 wherein the mobile phone includes a case for holding the mobile phone.

4. The shooting simulation system according to claim 3 wherein the case includes a pistol grip located on a lower surface of the case.

5. The shooting simulation system according to claim 4 wherein the grip includes a trigger.

6. The shooting simulation system according to claim 5 wherein the trigger is configured to indicate a trigger actuation for targeting.

7. The shooting simulation system according to claim 6 wherein the trigger is electronically coupled to the mobile phone.

8. The shooting simulation system according to claim 5 wherein the trigger passively provides a trigger actuation for targeting without an electronic connection between the trigger and the mobile phone.

9. The shooting simulation system according to claim 1 wherein the shooting communication device provides aural feedback of a hit or miss of a targeting by the shooting communication device.

10. The shooting simulation system according to claim 1 wherein the shooting communication device provides visual feedback of a hit or miss of a targeting by the shooting communication device.

11. The shooting simulation system according to claim 1 wherein the communication device of the targeted player provides aural feedback to the targeted player upon receiving notice of a hit of the simulated targeting by the shooting communication device.

12. The shooting simulation system according to claim 1 wherein the communication device of the targeted player provides visual feedback to the targeted player upon receiving notice of a hit of the simulated targeting by the shooting communication device.

13. The shooting simulation system according to claim 1 wherein the game server provides a hit criteria for a hit or miss of a targeted player.

14. The shooting simulation system according to claim 1 wherein the targeting simulates direct firing of a firearm at a target.

15. The shooting simulation system according to claim 1 wherein the targeting simulates targeting by indirect fire for striking a targeted player.

16. The shooting simulation system according to claim 1 wherein each communication device includes a camera for capturing images.

17. The shooting simulation system according to claim 1 wherein the indicia includes an identification of a communication device of a targeted player.

18. The shooting simulation system according to claim 1 wherein each communication device provides information of a location of a communication device of another player.

19. The shooting simulation system according to claim 1 wherein the network is a telecommunications network.

20. The shooting simulation system according to claim 1 wherein the network is a Wi-Fi network.

21. The shooting simulation system according to claim 1 wherein the game server informs the communication device of the target player of a hit of a simulated targeting by the shooting communication device.

22. The shooting simulation system according to claim 1 wherein the shooting communication device provides a hit criteria for a hit or miss of a targeted player.

23. A method of simulating targeting a target, the method comprising the steps of:

carrying a shooting communication device by a first player and a targeted communication device by a targeted second player;

determining a geographic location of the shooting communication device;

determining a geographic location of the targeted communication device;

relaying the geographic location of the targeted communication device to the shooting communication device through a network;

aiming and targeting the second player by the shooting communication device;

determining an orientation of the aimed shooting communication device;

determining, by a shooting processor of the shooting communication device, if the targeting is a hit based on the orientation of the aimed shooting communication device and the location of the targeted communication device; and providing immediate feedback of a hit or miss to a shooting player of the shooting communication device.

24. The method according to claim 23 wherein the step of relaying the geographic location of the targeted communication device includes relaying the geographic location to a game server communicating with the network.

25. The method according to claim 23 therein the network is a Wi-Fi network.

26. The method according to claim 23 wherein the network is a telecommunications network.

27. The method according to claim 23 wherein the shooting communication device and the targeted communication device are mobile phones.

28. The method according to claim 23 wherein the step of aiming and targeting the second player includes simulating firing of a firearm at a target.

29. The method according to claim 23 wherein the step of aiming and targeting the second player includes simulating targeting for a notional airborne drone to strike the second player.

30. The method according to claim 23 further comprising the step of informing the communication device of the targeted player of a hit from the simulated targeting by the shooting communication device.

* * * * *